US010723521B2

(12) United States Patent
Magana

(10) Patent No.: US 10,723,521 B2
(45) Date of Patent: Jul. 28, 2020

(54) CONTAINER ASSEMBLY

(71) Applicant: Direct Pack, Inc., Sun Valley, CA (US)

(72) Inventor: Leonardo Magana, San Bernardino, CA (US)

(73) Assignee: Direct Pack, Inc., Sun Valley, CA (US)

( * ) Notice: Subject to any disclaimer, the term of this patent is extended or adjusted under 35 U.S.C. 154(b) by 462 days.

(21) Appl. No.: 15/184,226

(22) Filed: Jun. 16, 2016

(65) Prior Publication Data

US 2016/0368669 A1 Dec. 22, 2016

Related U.S. Application Data

(60) Provisional application No. 62/180,298, filed on Jun. 16, 2015.

(51) Int. Cl.
*B65D 8/00* (2006.01)
*B65D 43/02* (2006.01)
(Continued)

(52) U.S. Cl.
CPC ..... *B65D 43/0204* (2013.01); *B65D 11/20* (2013.01); *B65D 21/0233* (2013.01);
(Continued)

(58) Field of Classification Search
CPC ..... B65D 43/0206; B65D 21/0234; B65D 21/00212; B65D 43/204; B65D 11/20;
(Continued)

(56) References Cited

U.S. PATENT DOCUMENTS 2,986,300 A 5/1961 Parrish
2,999,611 A 9/1961 Paulson
(Continued)

FOREIGN PATENT DOCUMENTS

CA 1072464 A 2/1980
CA 2127311 C 3/1995
(Continued)

OTHER PUBLICATIONS

International Search Report and Written Opinion dated Sep. 6, 2016 for Application No. PCT/US2016/037838, 10 pgs.
(Continued)

*Primary Examiner* — Elizabeth J Volz
(74) *Attorney, Agent, or Firm* — Frost Brown Todd LLC

(57) ABSTRACT

The present disclosure relates to a container assembly formed from a first shell component and a second shell component releasably locked together. The first shell component includes a first side wall, a first outer wall, a first male locking portion, and a first female locking portion. Similarly, the second shell component includes a second side wall, a second outer wall, a second male locking portion, and a second female locking portion. To form the container assembly, a user rotates the two shell components to be oriented 180-degrees with respect to one another and presses the two shell components together. Upon pressing, the first male locking portion is configured to releasably lock with the second female locking portion while the first female locking portion is configured to releasably lock with the second male locking portion to releasably hold the two shell components together.

20 Claims, 13 Drawing Sheets

(51) Int. Cl.
*B65D 21/02* (2006.01)
*B65D 81/32* (2006.01)
*B65D 6/00* (2006.01)

(52) U.S. Cl.
CPC ..... *B65D 21/0234* (2013.01); *B65D 43/0206* (2013.01); *B65D 81/3216* (2013.01); *B65D 2543/0062* (2013.01); *B65D 2543/00212* (2013.01); *B65D 2543/00296* (2013.01); *B65D 2543/00351* (2013.01); *B65D 2543/00462* (2013.01); *B65D 2543/00685* (2013.01); *B65D 2543/00731* (2013.01); *B65D 2543/00796* (2013.01)

(58) Field of Classification Search
CPC ..... B65D 21/0233; B65D 81/3216; B65D 2543/00212; B65D 2543/00296; B65D 2543/00351; B65D 2543/00462; B65D 2543/0062; B65D 2543/00685; B65D 2543/00731; B65D 2543/00796
USPC ... 220/4.24, 4.21, 4.25, 4.26, 669, 324, 793, 220/780
See application file for complete search history.

(56) References Cited

U.S. PATENT DOCUMENTS 3,902,540 A 9/1975 Commisso
4,014,450 A 3/1977 Girotti et al.
4,294,371 A 10/1981 Davis
4,742,935 A * 5/1988 Schellenberg ..... B65D 43/021 220/791
4,974,738 A 12/1990 Kidd et al.
5,036,980 A 8/1991 Vigue et al.
5,060,851 A 10/1991 Lorenz
5,273,174 A 12/1993 Fisher
5,310,070 A 5/1994 Haas et al.
5,332,114 A 7/1994 Sano et al.
5,356,023 A 10/1994 Krupa
5,377,860 A * 1/1995 Littlejohn ..... B65D 21/0219 220/4.21
5,390,807 A 2/1995 Galaburda
5,730,311 A 3/1998 Curtis
5,758,794 A 6/1998 Rider, Jr. et al.
5,979,687 A * 11/1999 Hayes ..... B65D 43/162 220/4.23
6,032,827 A 3/2000 Zettle et al.
6,085,930 A 7/2000 Curtis
6,092,719 A 7/2000 Capo
6,609,623 B2 * 8/2003 Chou ..... B65D 43/162 220/4.23
6,886,694 B2 5/2005 Mcneeley et al.
6,886,708 B2 5/2005 Kaufman et al.
6,923,338 B2 8/2005 Dees et al.
7,032,773 B2 4/2006 Dees et al.
7,055,712 B2 6/2006 Tang
7,118,003 B2 10/2006 Sellari et al.
D602,774 S 10/2009 Parikh et al.
7,726,483 B2 6/2010 Ramanujam et al.
7,798,353 B2 9/2010 Blythe et al.
8,006,863 B2 8/2011 Albrecht
8,056,750 B2 * 11/2011 Vovan ..... B65D 43/021 220/270
8,083,084 B2 12/2011 Vovan
8,083,089 B2 * 12/2011 Vovan ..... B65D 43/162 220/270
8,127,961 B2 3/2012 Vovan
8,251,249 B1 * 8/2012 Vovan ..... B65D 43/021 206/228
8,322,530 B2 12/2012 Furlong
8,322,553 B2 12/2012 Rider, Jr. et al.
8,343,560 B2 1/2013 Blythe et al.
8,561,823 B1 10/2013 Krupa
8,777,043 B2 7/2014 Furlong
9,493,277 B2 * 11/2016 Parikh ..... B65D 43/0254
2005/0016887 A1 * 1/2005 Yewdall ..... A61F 15/001 206/440
2005/0098554 A1 5/2005 Hayes et al.
2005/0161455 A1 * 7/2005 Studee ..... B65D 43/0281 220/266
2005/0189350 A1 9/2005 Hayes et al.
2005/0230389 A1 10/2005 Hayes et al.
2006/0159807 A1 7/2006 Hayes et al.
2006/0289541 A1 * 12/2006 Boback ..... B65D 43/0254 220/266
2007/0023428 A1 2/2007 Wambold et al.
2007/0138180 A1 * 6/2007 Vovan ..... B65D 43/021 220/266
2007/0295631 A1 12/2007 Lin et al.
2008/0237228 A1 10/2008 Chou
2009/0020540 A1 1/2009 Vovan
2011/0031152 A1 2/2011 Petlak et al.
2011/0315702 A1 * 12/2011 LeBoeuf ..... B65D 43/0208 220/793
2013/0161221 A1 6/2013 Furlong
2013/0175284 A1 7/2013 Chen
2014/0262909 A1 9/2014 Gartz et al.
2016/0001918 A1 * 1/2016 Orion ..... B65D 11/02 220/4.25

FOREIGN PATENT DOCUMENTS

CA 2209999 A1 7/1997
CA 2387178 A1 11/2002
CA 2455429 A1 7/2004
CA 2335982 C 8/2005
CA 2596671 A1 8/2007
CA 2601505 A1 9/2007
CA 2621274 A1 3/2008
CA 2503375 A1 4/2008
CA 2629126 A1 5/2008
CA 2580866 C 7/2008
CA 2551095 C 6/2010
CA 2682905 A1 2/2011
CA 2640959 C 3/2011
CA 2619288 C 10/2011
CA 2661895 C 12/2012
CA 2845431 A1 9/2014
DE 2628049 A1 11/1977
GB 2372983 A 9/2002
RU 2301186 C1 6/2007

OTHER PUBLICATIONS

Canadian Office Action dated Apr. 9, 2018 for Application No. CA 2,988,138, 5 pgs.

* cited by examiner

CONTAINER ASSEMBLY

PRIORITY

This application claims priority to U.S. Provisional Patent Application Ser. No. 62/180,298, filed Jun. 16, 2015, entitled "Container Assembly," the disclosure of which is incorporated by reference herein.

BACKGROUND

Base and lid containers are typically used in the food preparation and restaurant industry to package prepared or take-out foods. However, base and lid container have a significant volume footprint and food establishments are often limited in space, particularly the area around the main cooking or serving space. Accordingly, it may be desirable to reduce storage space through the use of more convenient packaging material. Further, a food establishment using a base and a lid container may come up short when either the lid or base to complete the container is dropped or otherwise removed from the pool of bases or lids. This creates a discrepancy in the ratio of lids to bases in the container stock.

The present disclosure relates to containers and packaging. More particularly, the present disclosure relates to a container assembly that incorporates ambidextrous or balanced shell components for forming the two sides of a complete container assembly. Specifically, the present disclosure relates to a container assembly having two shell components that include substantially similar profile and may be rotated 180-degrees relative to one another and brought together to form the container assembly. In some embodiments, the shell components include a generally identical overall footprint profile. In other embodiments, the outer peripheral lip or edge area of both shell components are generally identical, while the depths can be identical or are different.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
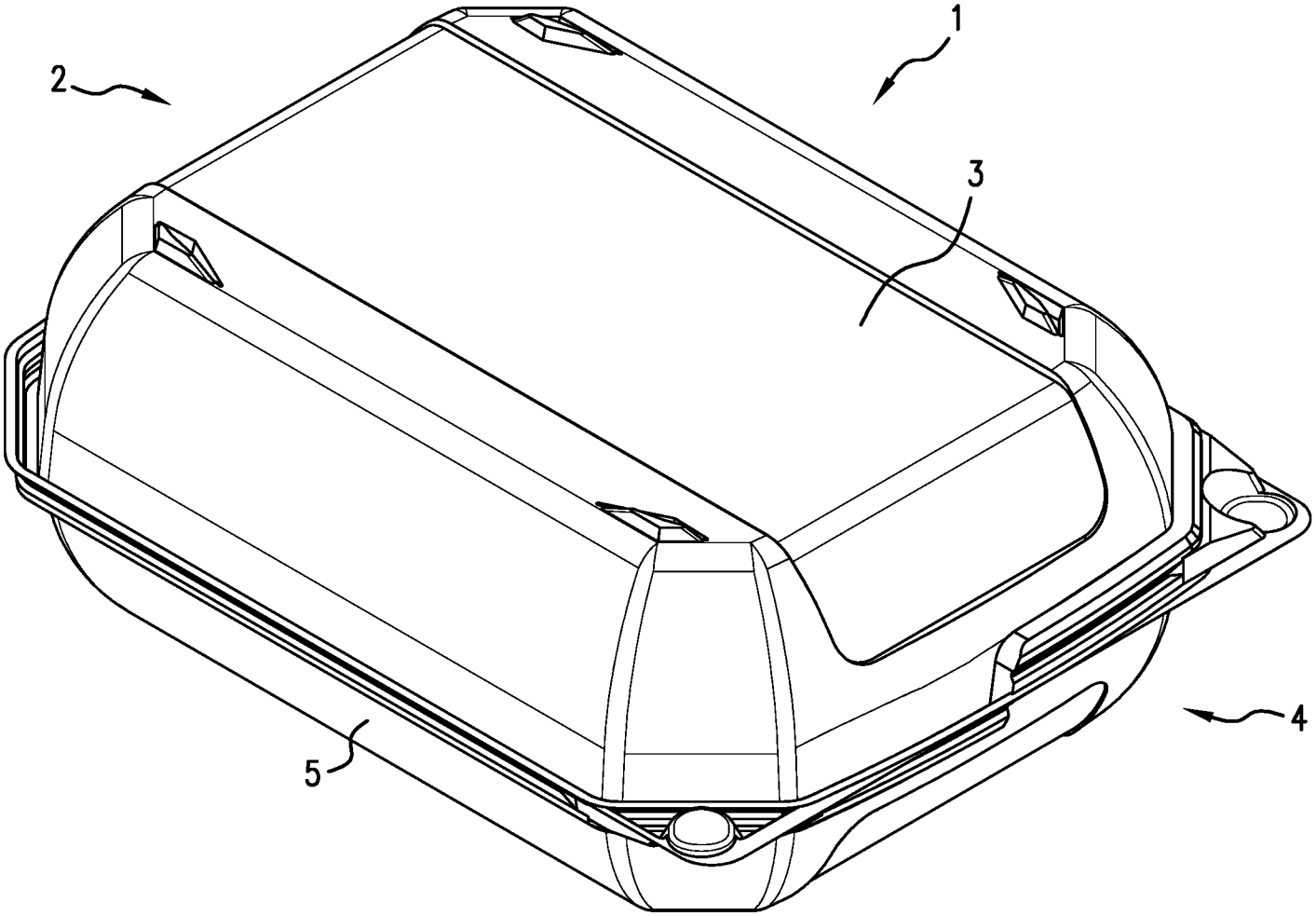
FIG. 1 depicts a perspective view of an exemplary container assembly of the present disclosure.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It will be appreciated that any one or more of the teachings, expressions, versions, examples, etc. described herein may be combined with any one or more of the other teachings, expressions, versions, examples, etc., that are described herein. The following-described teachings, expressions, versions, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

I. Overview of Container Assembly

A container assembly is comprised of two shell components having an ambidextrous locking features that allows either shell component to be used as a base or a lid. Each shell component includes both a male lock feature and a female lock feature that allow two of the same component to interlock as one container. Other types of locking features may be used such as tabbed locks, bar locks, button locks, rim locks, inside and outside locks, etc. Each shell component may have varying depths or fill capacities with the same footprint to allow for various container combinations. For instance, a first shell component may have a shallow depth and a second shell component may have a deep depth with the same footprint as the first shell component. This allows a user to form three different combinations of containers, i.e., a shallow-shallow container, a shallow-deep container, and a deep-deep container. Any number of shell components may be used with varying depths to allow for more combinations and versatility for containers.

Some embodiments of the container assembly include an ambidextrous locking feature whereby a male lock feature extends outwardly from the shell component and is positioned about half of the perimeter of the shell component. A female lock feature is then recessed on the shell component and is positioned about the remaining half of the perimeter of the shell component. Of course, the male and female locking features may be positioned along any portion or section of the perimeter of the shell component. Accordingly, a shell component may be inverted to be positioned above an identical shell component, or a shell component having the same footprint, to align a male locking feature of one shell component with a female locking feature of the other shell component. The male and female locking features may then be coupled to insert the male locking feature within the female locking feature to secure the shell components together. The shell components may also be pulled apart to remove the locking features and again open the container.

Each shell component further may comprise a tab extending beyond the perimeter of the shell component. Accordingly, when two shell components are coupled together, the tab of each shell component extends over a chamfered corner of the container. This may ease the opening of the container. For instance, a user may pull upwardly on the tab of the top shell component and/or pull down on the tab of the bottom shell component to pull the shell components apart and open the container. The tabs may also be positioned along other edges of the shell component. The tabs may be a button lock style tab or any other style of tabbing or locking features. Further, the chamfered corner may be omitted and a locking type of tab may be used, whereby a feature of the top tab interlocks with a feature of the bottom tab.

In some instances, it may be desirable to stack containers and/or shell components on top of each other. To provide stability during stacking, each shell component may comprise offset male and female posts, whereby each corner includes a male post that extends outwardly from the shell component and a female post adjacent to the male post that is recessed within the shell component. The female post is sized to correspond to the male post such that the female post is configured to receive the male post. In some embodiments of the container assembly, the posts include a triangular shape. However, any other suitable shape may be used in forming the posts. The outer surface of a first shell component can be stacked onto the outer surface of a second shell component to align the male posts with corresponding female posts. This may prevent the shell components from sliding relative to each other to provide more stability in a stacked position. While some embodiments of the container assembly include four pairs of offset posts, any other suitable number of posts may be used.

The shell components may comprise any suitable shape. For instance, each shell component may be generally square shaped, rectangular shaped, or oval shaped. However, any other shape may be used, particularly if each interlocking shell component comprises the same footprint. Shell components may include venting or define openings therein to control the heat environment within the container.

Some embodiments of a shell component may omit locking tabs that extend beyond the perimeter of the shell components of the container. Once the male and female locking features are coupled to secure the shell components together, a user may then squeeze any pair of opposing sidewalls of a shell component of the container to release the locking features and open the container.

The shell components can also include interchangeable features where various shell component features can be adapted and combined with other shell component features for any desired application. For instance, a clear shell component can be combined with an opaque shell component, a patterned shell component can be combined with an unpatterned shell component, a branded shell component can be combined with an unbranded shell component, a labeled shell component can be combined with an unlabeled shell component, a colored can be combined with a clear shell component, or any combination thereof, etc.

The shell components can be made of plastic, such as thermoformed polyethylene terephthalate, recycled plastic, or any other suitable material.

Some embodiments of the container assembly include a first shell component having an ambidextrous locking feature and a second shell component having an ambidextrous locking feature, wherein the first shell component and the second shell component comprise the same footprint such that the ambidextrous locking feature of the first shell component is configured to interlock with the ambidextrous locking feature of the second shell component to removably couple the first shell component with the second shell component. Some embodiments of the container assembly include a male locking portion and a female locking portion, wherein the male locking portion of the first shell component is configured to be inserted within the female locking portion of the second shell component and the male locking portion of the second shell component is configured to be inserted within the female locking portion of the first shell component. In some embodiments of the present disclosure, the first shell component has a different depth than the second shell component. In some embodiments of the present disclosure, each shell component comprises a tab extending outwardly from a perimeter of the shell component. In some embodiments of the present disclosure, each shell component comprises a pair of offset posts that includes a male post and a female post, wherein the female post is sized to receive the male post.

II. Exemplary Shell Component of Container Assembly

Figure 2:
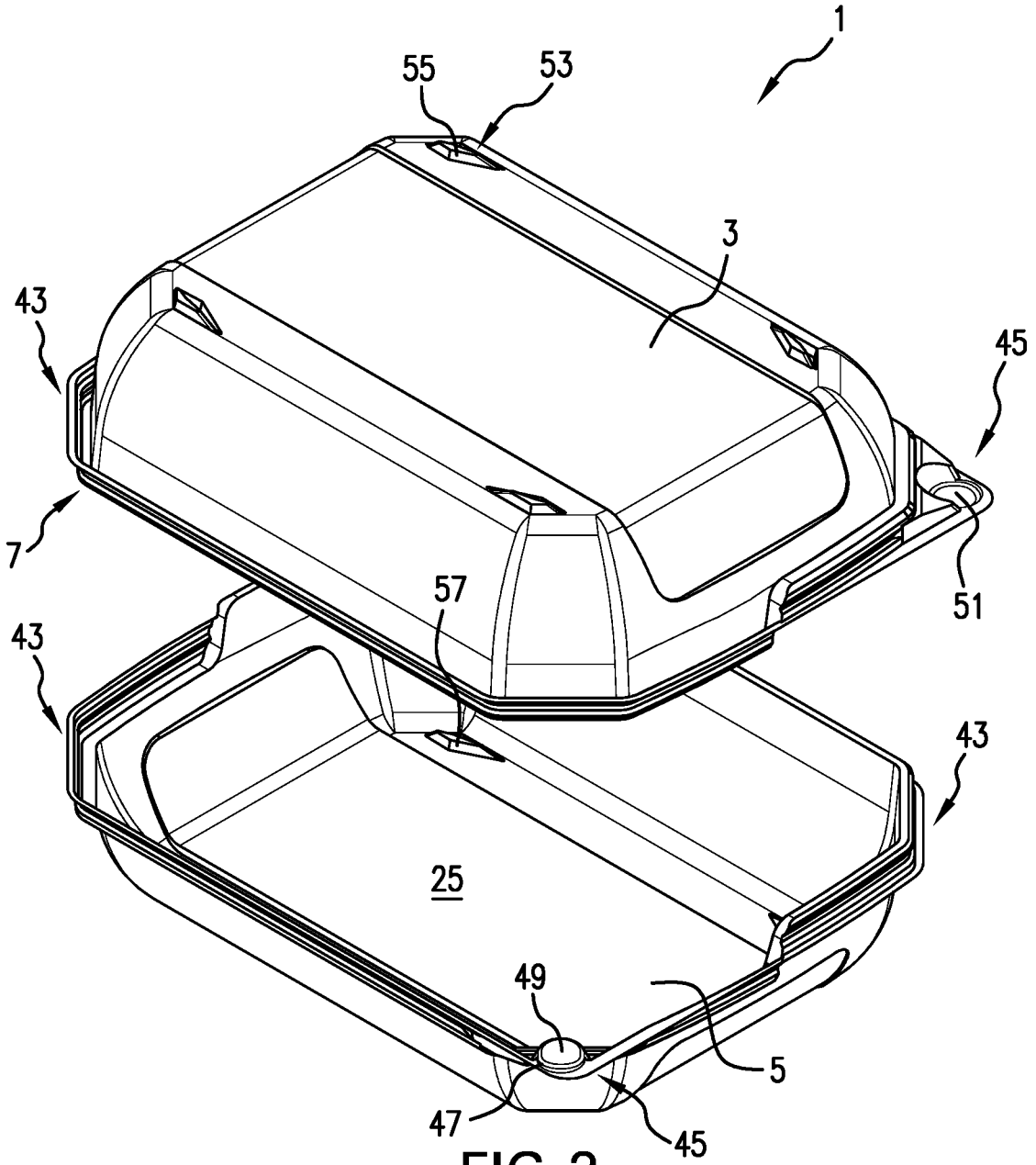
FIG. 2 depicts a view similar to FIG. 1 with two shell components of the container assembly separated and spaced apart.
Figure 3:
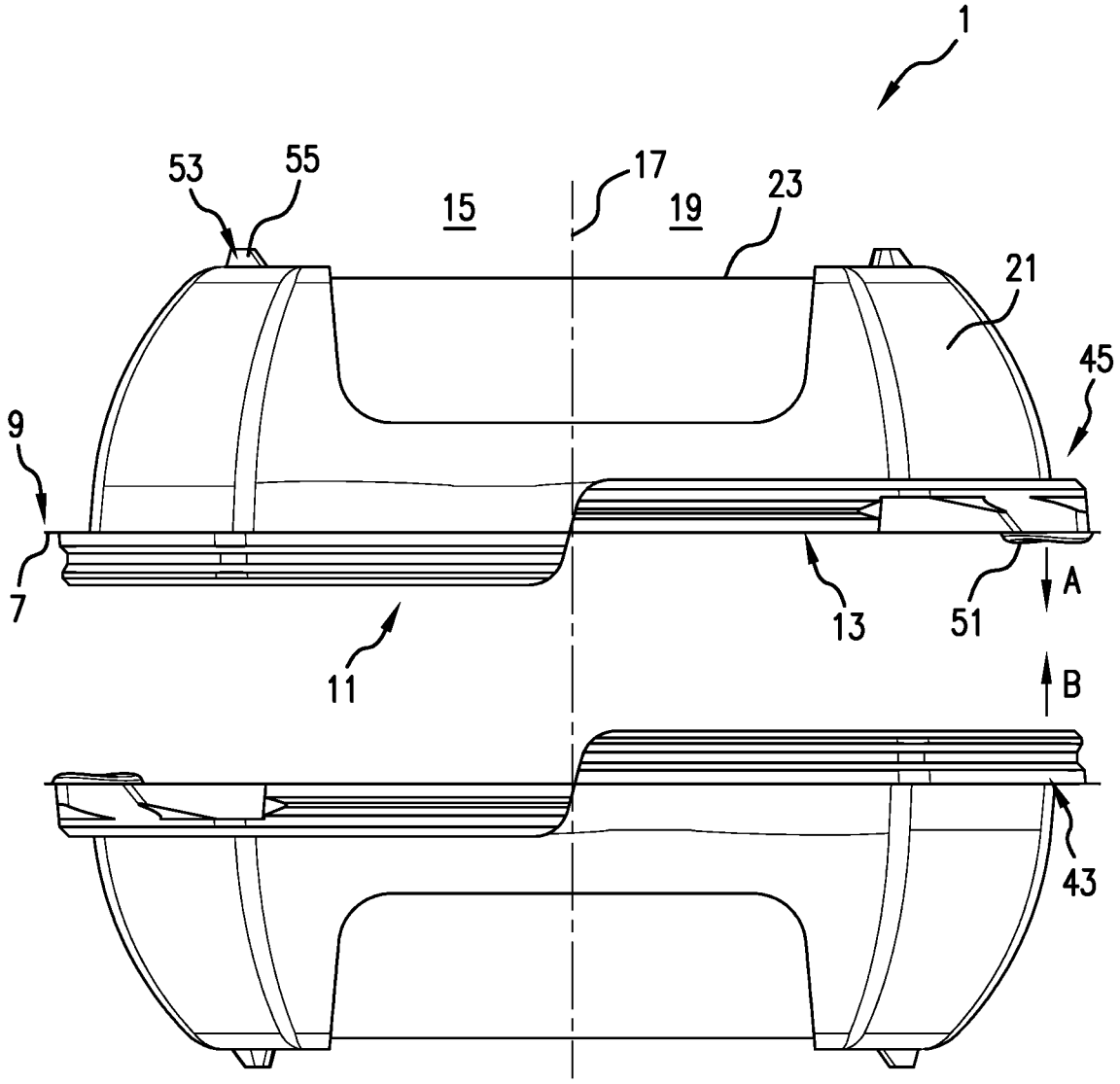
FIG. 3 depicts a side elevational view of the two shell components of the container assembly spaced apart.

As shown in FIGS. 1-3, a container assembly (1) may be disposed in an assembled orientation (FIG. 1) and an unassembled orientation (FIG. 2). Container assembly (1) extends from a first side (2) to a second side (4) in the assembled orientation and is comprised of a shell component (3) releasably secured to a shell component (5). In the illustrated embodiment, shell component (3) and shell component (5) are substantially similar, rotated 180-degrees, and press fit together to releasably secure shell component (3) with shell component (5). In some embodiments of container assembly (1), shell component (3) and shell component (5) are formed from the same mold or manufacturing process. In other embodiments, shell component (3) and shell component (5) have differing depths. Inasmuch as shell component (3) and shell component (5) are substantially similar, one will readily recognize that any element reference made to shell component (3) are also present in shell component (5), unless otherwise stated.

As shown in FIGS. 2 and 3, each shell component (3, 5) includes an outer peripheral lip (7) extending around the entire periphery of shell component (3, 5) and defining an outer edge (9). For each shell component (3, 5) outer peripheral lip (7) is adjacent to a male projection region (11), extending approximately one half of the length of peripheral lip (7). Similarly, peripheral lip (7) is adjacent to a female recess region (13), extending the remaining approximately one half of the length of peripheral lip (7).

In order to connect shell component (3) with shell component (5), the two shell components (3, 5) are oriented to be 180-degrees with respect to one another, as illustrated in FIG. 3. In the embodiment of container assembly (1) depicted in FIGS. 1 and 3, male projection region (11) of shell component (3) is disposed on a first side (15) of an imaginary longitudinal plane (17), wherein imaginary longitudinal plane (17) generally bisects each shell component (3, 5) along the midline. Similarly, female recess region (13) of shell component (3) is disposed on a second side (19) of imaginary longitudinal plane (17). Inasmuch as the shell components (3, 5) are oriented 180-degrees with respect to one another, male projection region (11) of shell component (5) is disposed on second side (19) of imaginary longitudinal plane (17), while female recess region (13) of shell component (5) is disposed on first side (15) of imaginary longitudinal plane (17).

Each shell component (3, 5) further includes a sidewall (21) extending around the entire periphery of shell component (3, 5). Sidewall (21) abuts a generally flat outer wall (23) oriented generally parallel to peripheral lip (7). Outer wall (23) forms either the top or the bottom of container assembly (1) when container assembly (1) is in the assembled orientation, depending on the position of the particular shell component (3, 5) relative to the other shell component (3, 5). As shown in FIG. 2, sidewall (21) and outer wall (23) cooperate to define an interior pocket (25) sized to receive various foodstuffs or other elements therein as desired.

Figure 4:
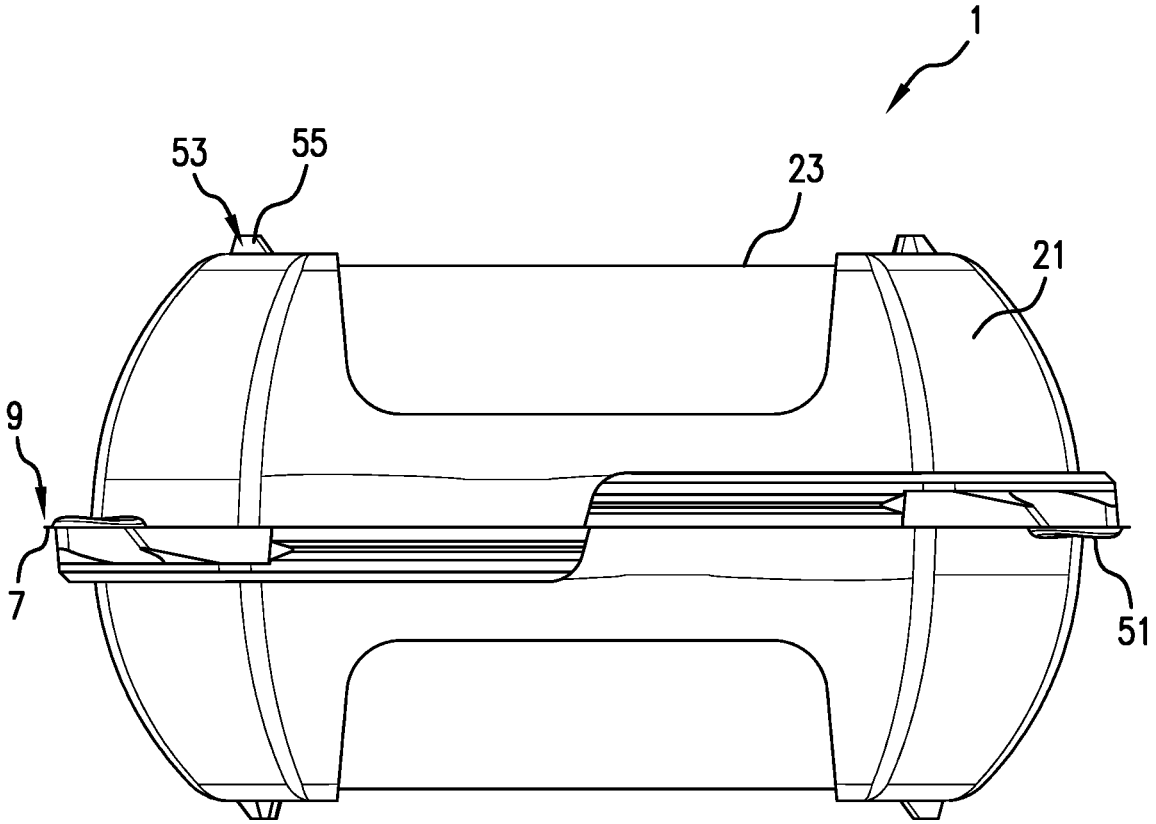
FIG. 4 depicts a view similar to FIG. 3 with the two shell components removably secured together to form the container assembly.
Figure 5:
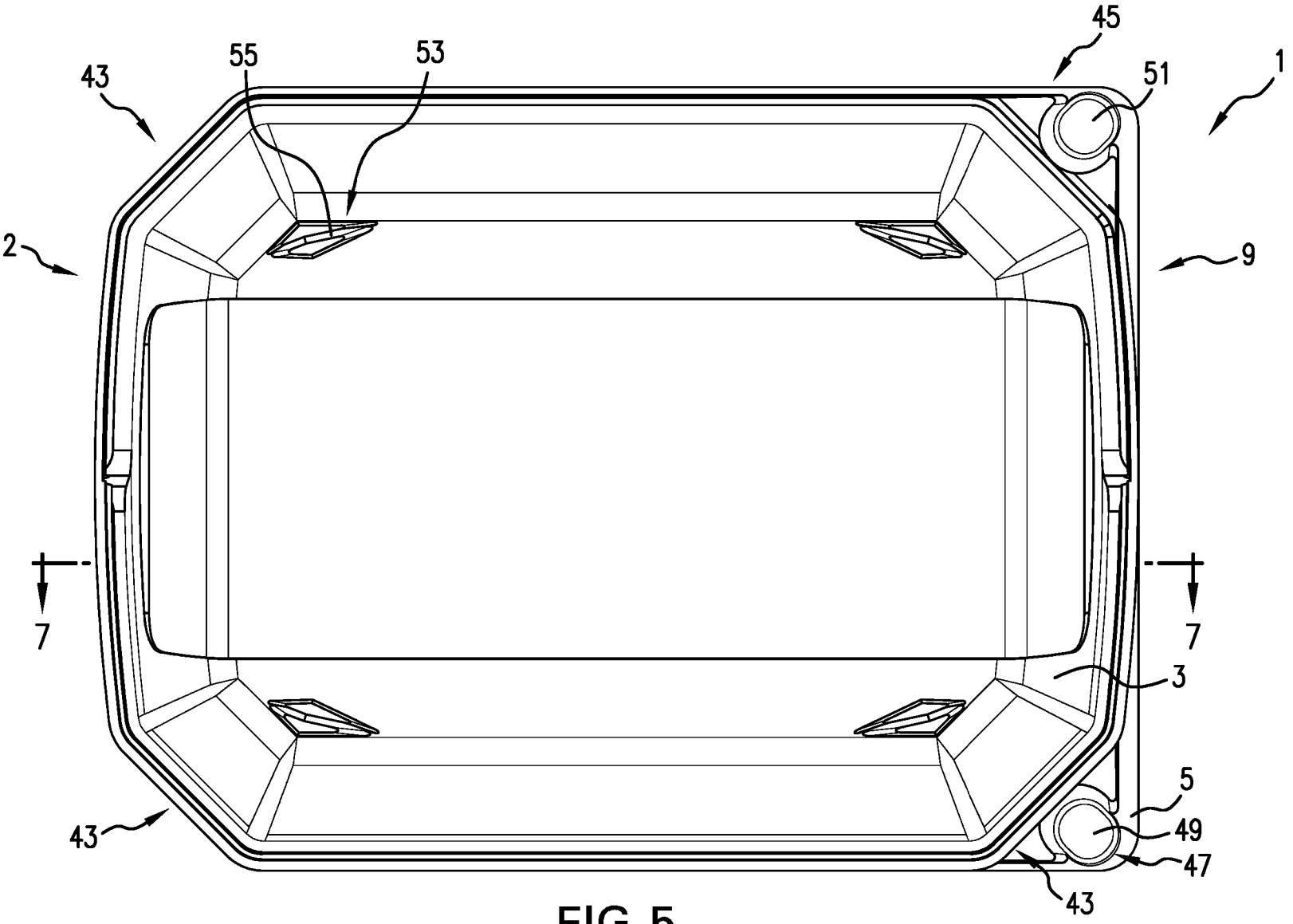
FIG. 5 depicts a top view of the container assembly of FIG. 1.

With reference to FIGS. 3-5, shell component (3) may be rotated 180-degrees with respect to shell component (5) and press fit together to releasably lock shell component (3) with shell component (5) and transform container assembly (1) to the assembled orientation (FIG. 1) from the unassembled orientation (FIG. 2). As shown in FIG. 3, shell component (3) is manually pressed in the direction of Arrow A, while shell component (5) is manually pressed in the direction of Arrow B, whereby the two shell components (3, 5) engage one another to releasably lock together, as shown in FIG. 4. Each male projection region (11) of the two shell components (3, 5) interlock with the opposing female recess region (13) of the opposite shell component (3,5).

As shown in FIGS. 2 and 5, each shell component (3, 5) includes three chamfered corners (43) along peripheral lip (7). The fourth corner of each shell component (3, 5) is an unchamfered corner (45). While FIGS. 2 and 5 depict the unchamfered corner (45) disposed along the female recess region (13) of each shell component (3, 5), unchamfered corner (45) may be disposed at any desired corner area of shell component (3, 5) and formed in any desired shape. Similarly, more than one unchamfered corner (45) may be used in alternative embodiments. Unchamfered corner (45) defines a tab (47). Tab (47) is defined by a projection (49) extending outwardly away from peripheral lip (7) and a complementary recess (51) on the opposite side of projection (49) and peripheral lip (7). In some embodiments of shell component (3, 5) tab (47) is stamped or molded from the material forming peripheral lip (7), whereby peripheral lip (7) is pressed or stamped to form tab (47) as an integral feature of shell component (3, 5).

As shown in FIGS. 2 and 5, when container assembly (1) is in the assembled orientation, unchamfered corner (45) and tab (47) for each shell component (3, 5) are disposed on second side (4) of container assembly (1). This allows a user to manually grasp container assembly (1) generally proximate first side (2) with one hand and manually pry apart second side (4) using both or a selected tab (47) of shell components (3, 5). While shell components (3, 5) are capable of being releasably secured tighter, each shell component is reflectively asymmetrical as well as rotationally asymmetrical due to unchamfered corner (45), tab (47), male projection region (11), and female recess region (13).

With particular reference to FIGS. 2 and 3, each shell component (3, 5) includes four feet (53) extending outwardly away from outer wall (23) and generally disposed proximate one of the chamfered corners (43) or the unchamfered corner (45). Feet (53) allow each shell component (3, 5) and, when assembled, the container assembly (1) to rest in a stable manner on a surface by way of feet (53). Each one of feet (53) include a projection (55) extending outwardly away from outer wall (23) and a complementary recess (57) defined by outer wall (23) and open to interior pocket (25). In some embodiments of shell component (3, 5) each one of feet (53) are stamped or molded from outer wall (23), whereby outer wall (23) is pressed or stamped to form each one of feet (53) as an integral feature of shell component (3, 5).

Figure 6:
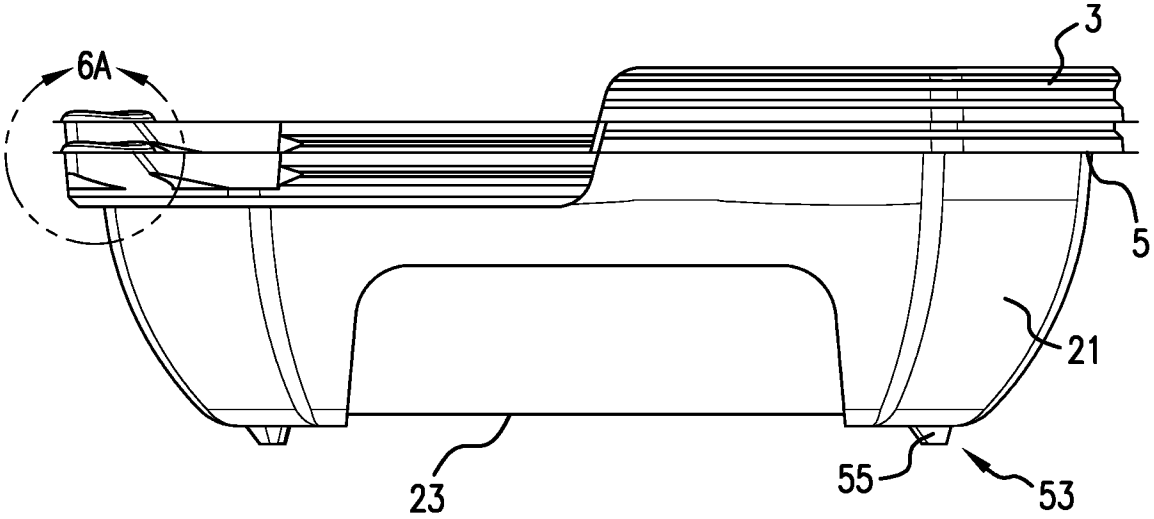
FIG. 6 depicts a side elevational view of two shell components nested together.
Figure 6A:
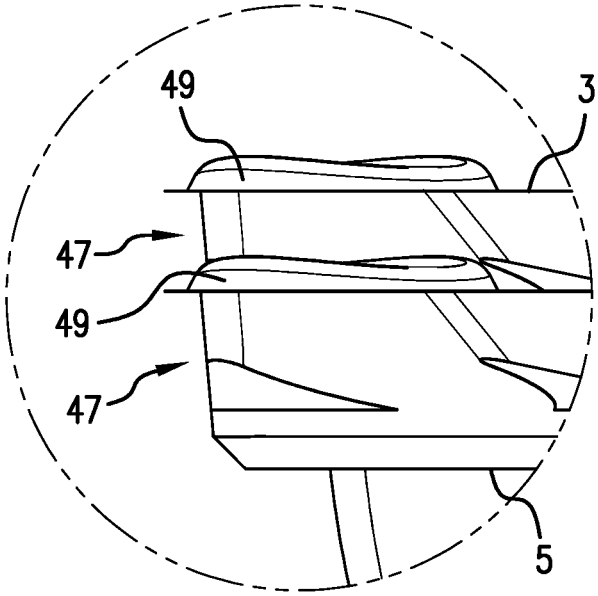
FIG. 6A depicts an enlarged area of FIG. 6.

As shown in FIGS. 6 and 6A, shell component (3) may be inverted and disposed within shell component (5) to nest shell components (3, 5) and reduce the amount of space required to store shell components (3, 5) when container assembly 1 is in the nested orientation (FIG. 6). In the nested orientation, the complementary and inverted shapes of the various elements of each shell component (3, 5) facilitate a tight complementary fit between shell component (3, 5). As shown in FIG. 6, sidewall (21) and outer wall (23) of shell component (3) is slidably received in interior pocket (25) of shell component (5). Similarly, each projection (55) of feet (53) of shell component (3) is received, in whole or in part, in recess (57) of the corresponding one of the feet (53) of shell component (5). Similarly, as shown in FIG. 6A, tab projection (49) of tab (47) of shell component (5) is received, in whole or in part, in tab recess (51) of shell component (3), as tab projection (49) and tab recess (51) are complementarily shaped.

As shown in FIGS. 7, 7A, 7B, and 7C, male projection region (11) and female recess region (13) of each shell component (3, 5) are configured to fit together to releasably secure shell components (3, 5) together. As show in FIGS. 7A and 7B, male projection region (11) for each shell component (3, 5) includes a lower male wall (27) extending generally parallel with lip (7) and outwardly away from sidewall (21). Lower male wall (27) includes a first male lip (29), a second male lip (31), and a male recess (33) defined therebetween. In general, male projection region (11) includes a general profile configured to mate with a complementary general profile of female recess region (13).

Figure 7:
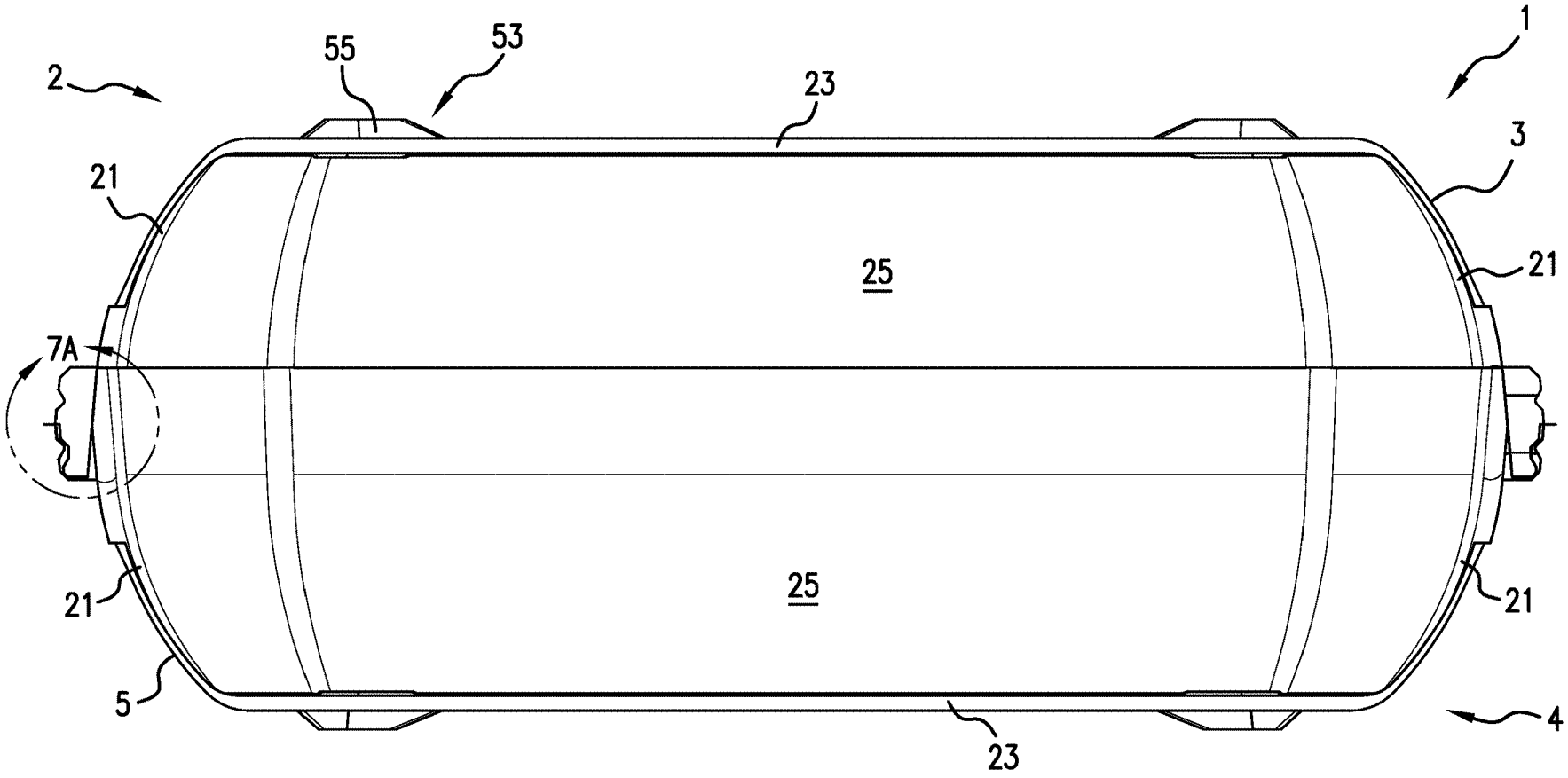
FIG. 7 depicts a cross-sectional view taken along line 7-7 of FIG. 5.
Figure 7A:
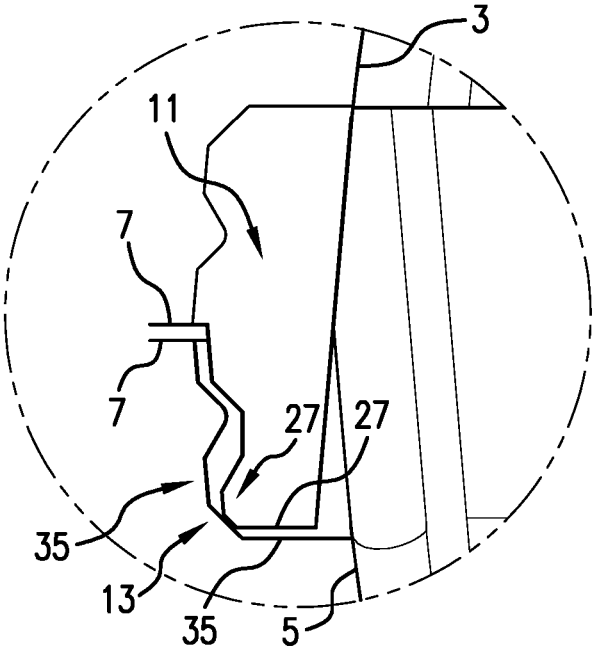
FIG. 7A depicts an enlarged cross-sectional view of the encircled area of FIG. 7.
Figure 7B:
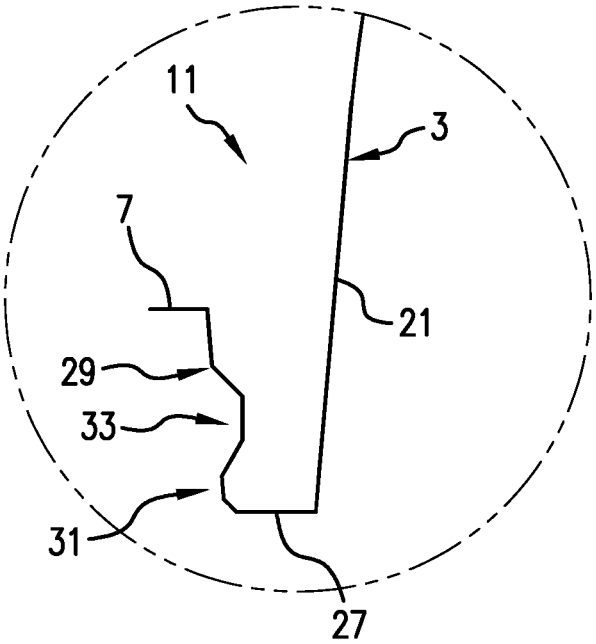
FIG. 7B depicts an enlarged cross-sectional view of a male projection region of a shell component of the present disclosure of FIG. 7.
Figure 7C:
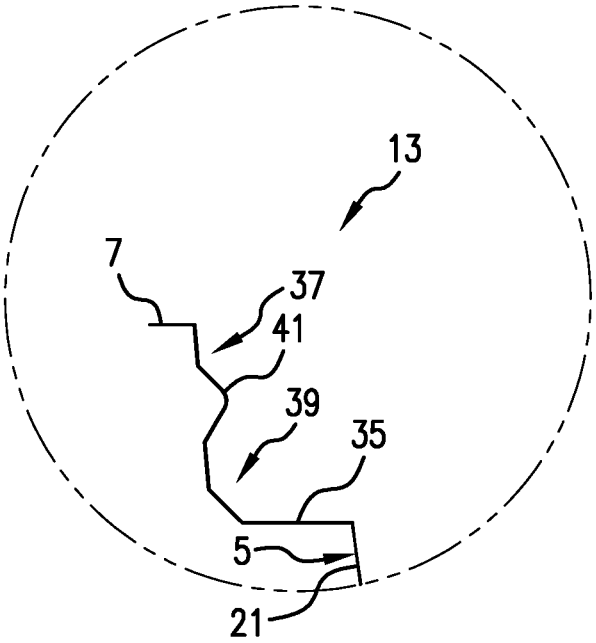
FIG. 7C depicts an enlarged cross-sectional view of a female projection region of a shell component of the present disclosure of FIG. 7.

As shown in FIGS. 7A and 7C, female recess region (13) for each shell component (3, 5) includes a lower female wall (35) extending generally parallel with lip (7) and outwardly away from sidewall (21). Lower female wall (35) includes a first female recess (37), a second female recess (39), and a female lip (41) extending therebetween.

With reference to FIGS. 7-7C, when shell component (3) and shell component (5) are rotated 180-degrees relative to one another and pressed together, male projection region (11) for each shell component (3, 5) aligns with female recess region (13) of the opposite shell component (3, 5). As the shell components (3, 5) are pressed together, male projection region (11) presses into female recess region (13), until lower male wall (27) abuts lower female wall (35) and lip (7) of shell component (3) abuts lip (7) of shell component (5). The connection of shell components (3, 5) disposes first male lip (29) within first female recess (37), second male lip (31) within second female recess (39), and female lip (41) within male recess (33). Such an orientation provides three distinct and generally vertical abutment areas between opposing shell components (3, 5) when container assembly (1) is in the assembled orientation. The connection of shell components (3, 5) further abuts lower male wall (27) against lower female wall (35) and lip (7) of each shell component (3, 5) against the opposing lip (7) of the other shell component (3, 5). Such an orientation provides two distinct and generally horizontal abutment areas between opposing shell components (3, 5) when container assembly (1) is in the assembled orientation. The vertical and horizontal abutments between male projection regions (11) and female recess regions (13) provide a tight seal around the entire periphery of container assembly (1) and act to hold any contents of container assembly (1) therein.

Figure 8:
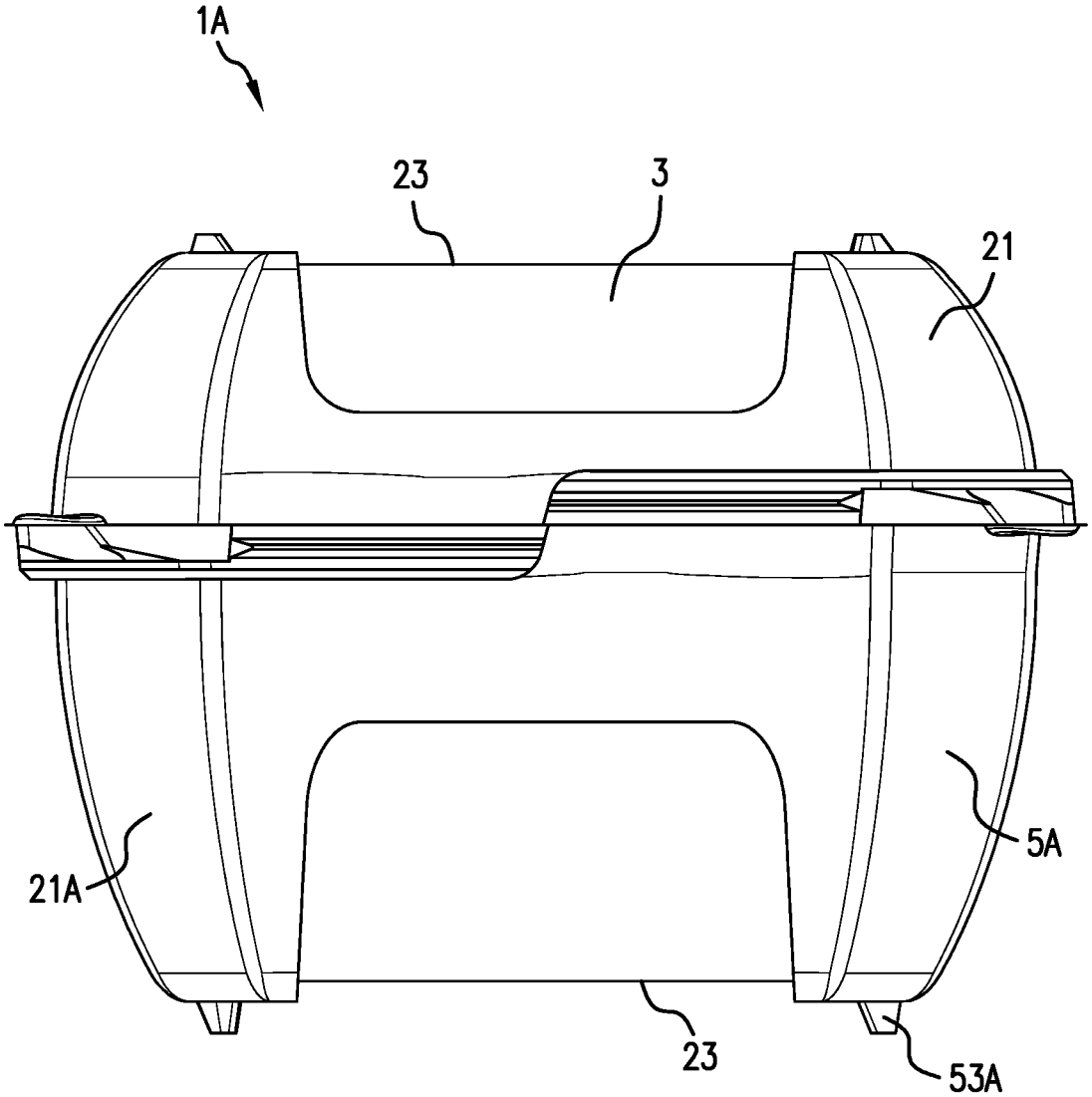
FIG. 8 depicts a side elevational view of another embodiment of the container assembly having a top shell component and a bottom shell component having different depths.

With reference to FIG. 8, shell components may be selected and paired to build a container assembly having one or more particular desired underlying features. For example, a particular shell component (5A) may include a deeper interior pocket (25) defined by an elongated sidewall (21A) and enlarged feet (53A) to support the increased capacity of a particular shell component (5A). When shell component (3) is secured to a particular shell component (5A) to form a container assembly (1A), a deeper lower space within container assembly (1A) is provided by way of an elongated sidewall (21A). Shell components incorporating sidewall (21) having different lengths may be provided to allow a user to customize the resulting container assembly (1) by selecting different sized shell components and forming container assembly (1) accordingly.

III. Exemplary Method of Using the Container Assembly

Figure 9:
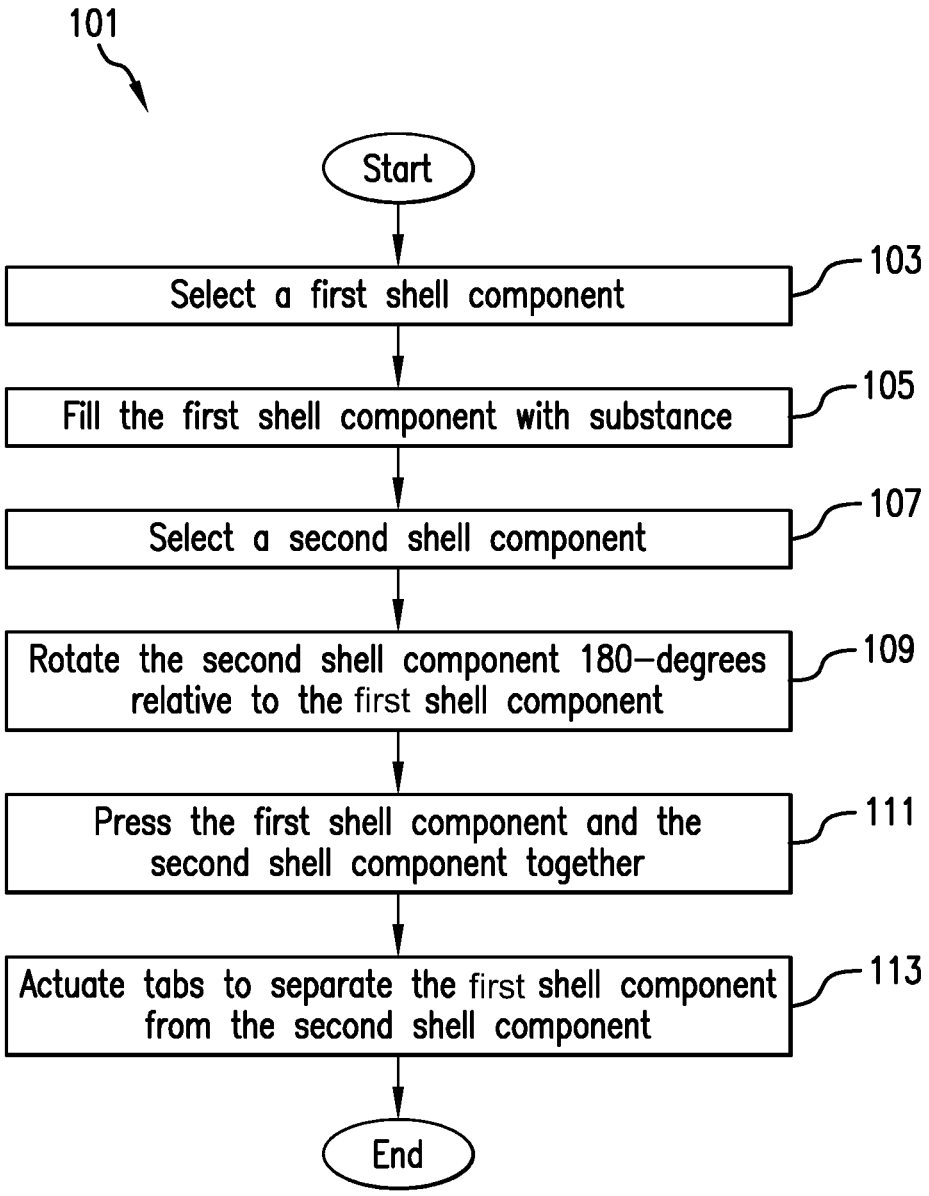
FIG. 9 depicts an exemplary method of using a container assembly of the present disclosure.

A method (101) for using container assembly (1) is illustrated in FIG. 9. Method (101) begins with a step (103), whereby a user selects a first shell component. Shell components may be stacked and nested with one another similar to those shown in FIG. 6, or may include several stacks of shell components having differing length sidewalls, similar to shell component (3) and shell component (5A) of FIG. 8. The user may observe and select whichever shell component is best suited for the underlying needs of the user. After the user selects the first shell component, step (103) proceeds to a step (105).

In step (105), the user fills the first shell component with a substance such as a salad or other foodstuffs. Naturally, the first shell component is oriented such that interior pocket (25) of the selected first shell component is facing upwardly and able to receive the substance therein without spilling or leakage. The user might rest the first shell component on feet (53) to stabilize the first shell component while the user loads the substance into interior pocket (25). Thereafter, step (105) proceeds to a step (107).

In step (107), the user selects a second shell component based on the needs of the user and the underlying substance to be contained in the container assembly. The second shell component may be thought of as the top of the container assembly, as the first shell component is already loaded with a substance. After the user selects the second shell component, step (107) proceeds to a step (109).

In step (109), the user rotates the selected second shell component 180-degrees relative to the selected first shell component. The rotation orients the male projection region (11) of the first shell component with the female recess region (13) of the second shell component. The rotation further orients the female recess region (13) of the first shell component with the male projection region (11) of the second shell component. Thereafter, step (109) proceeds to a step (111).

In step (111), the user presses the first shell component and the second shell component together to engage the male projection regions (11) with the female recess regions (13). The pressing of the shell components together forms the container assembly in the assembled orientation (FIG. 1). The engagement between the first shell component and the second shell component forms a tight seal along the entire periphery of the resulting container assembly and acts to tightly hold the substance therein. The user may then transport the container assembly to a desired location without the contents of the container assembly spilling or becoming dislodged from inside the container assembly. Thereafter, step (111) proceeds to a step (113).

In step (113), the user may desire to open the container assembly to access the contents therein. To accomplish this, the user grasps the container assembly, typically with one had on the first shell component and the other hand on the second shell component, proximate tabs (47). The user then actuates each tab (47) of the associated shell component to pry apart the first shell component from the second shell component. As illustrated in FIGS. 1, 2, and 5, one of the chamfered corners (43) of the first shell component is disposed proximate the unchamfered corner (45) of the second shell component when the container assembly is in the assembled orientation. Similarly, one of the chamfered corners of the second shell component is disposed proximate the unchamfered corner (45) of the first shell component when the container assembly is in the assembled orientation. The placement of a chamfered corner (43) proximate an unchamfered corner (45) allows a user to grasp and actuate the tab (47) of the unchamfered corner (45) and facilitate the prying apart the two shell components. After the user has selectively sealed and unsealed container assembly as desired, process (101) proceeds to end.

Figure 10:
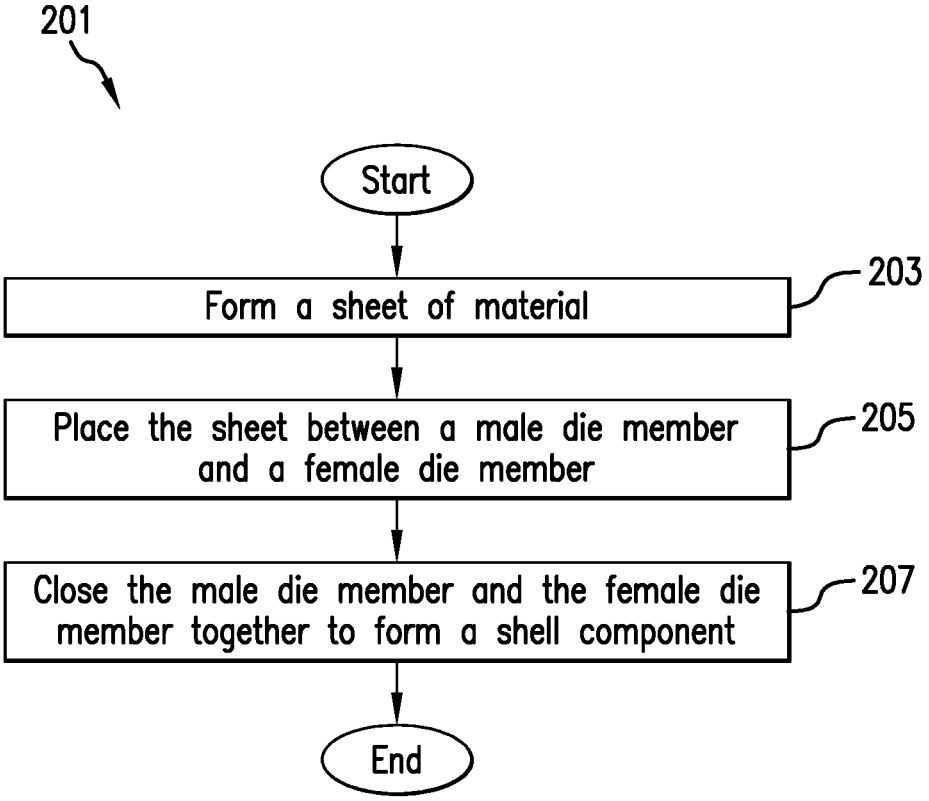
FIG. 10 depicts an exemplary method of manufacturing a shell component of a container assembly of the present invention.

IV. Exemplary Method of Manufacturing an Exemplary Shell Component of the Container Assembly A method (201) for manufacturing a shell component of container assembly (1) is illustrated in FIG. 10. Method (201) begins with a step (203), whereby a sheet of material is formed. In some embodiments of the shell component, a plastic or paper material may be used to form the sheet material. The sheet material may be formed from thermoplastic materials such as polyethylene terephthalate, polypropylene, etc., recycled plastic materials, or any other materials. After the sheet of material is formed, step (203) proceeds to a step (205).

In step (205), the sheet of material is placed into a mold machine or a mold mechanism, which may comprise a male die member and a female die member. In some embodiments of the shell component, either the male die member or the female die member is omitted and the sheet of material is placed proximate the solitary die member. For example, the sheet of material may be placed proximate a male die member and pressed down thereon to mold the sheet of material. However, any mechanism for molding the sheet of material into a shell component may be used, including injection blow molding, sintering, compression molding, extrusion molding, injection molding, laminating, matrix molding, rotational molding, spin casting, transfer molding, thermoforming, and/or vacuum forming. After the sheet of material is placed in a mold mechanism such as the male die member and the female die member, step (205) proceeds to a step (207).

In step (207), the male die member and the female die member are closed together to clamp the sheet of material therebetween. In some embodiments, one or both of the male die member and the female die member may be heated up during step (207) or may be previously heated to aid in the molding of the sheet of material. As the male die member and the female die member are closed together, the sheet of material conforms to this male/female shape and a shell component is formed between the die members by pressing on the sheet of material and aided by vacuum forming. Thereafter, the scrap material may be cut off the molded shell component. Alternatively, the sheet of material may be sized and shaped to transition into the shell component without any scrap or trim material left thereafter. After the shell component is formed from the sheet of material, process (201) proceeds to end.

V. Exemplary Combinations

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

EXAMPLE 1

A container assembly comprising a first shell component, wherein the first shell component includes a first side wall, a first outer wall, a first male locking portion, and a first female locking portion; a second shell component, wherein the second shell component includes a second side wall, a second outer wall, a second male locking portion, and a second female locking portion; wherein the first male locking portion is configured to releasably lock with the second female locking portion; and wherein the first female locking portion is configured to releasably lock with the second male locking portion.

EXAMPLE 2

The container assembly of Example 1, wherein the first shell component is reflectively asymmetrical, and wherein the first shell component is rotationally asymmetrical.

EXAMPLE 3

The container assembly of any combination of Examples 1-2, wherein the first male locking portion includes a first male lip or body or frame, wherein the second female locking portion includes a first female recess, and wherein the first female recess is configured to receive the first male lip therein when the second female locking portion is releasably locked with the first male locking portion.

EXAMPLE 4

The container assembly of any combination of Examples 1-3, wherein the first male locking portion includes a second male lip, wherein the second female locking portion includes a second female recess, and wherein the second female recess is configured to receive the second male lip therein when the second female locking portion is releasably locked with the first male locking portion.

EXAMPLE 5

The container assembly of any combination of Examples 1-4, wherein the first male locking portion includes a male recess disposed between the first male lip and the second male lip, wherein the second female locking portion includes a female lip disposed between the first female recess and the second female recess, and wherein the male recess is configured to receive the female lip therein when the second female locking portion is releasably locked with the first male locking portion.

EXAMPLE 6

The container assembly of any combination of Examples 1-5, wherein the first male locking portion includes a lower male wall, wherein the second female locking portion includes a lower female wall, and wherein the lower male wall is configured to abut the lower female wall when the second female locking portion is releasably locked with the first male locking portion.

EXAMPLE 7

The container assembly of any combination of Examples 1-6, wherein the lower male wall is parallel with the first outer wall, and wherein the lower female wall is parallel with the second outer wall when the second female locking portion is releasably locked with the first male locking portion.

EXAMPLE 8

The container assembly of any combination of Examples 1-7, wherein the first shell component includes a lip extending along the entire periphery of the first shell component, wherein the second shell component includes a lip extending along the entire periphery of the second shell component, wherein the lip of the first shell component is parallel with the lip of the second shell component when the second female locking portion is releasably locked with the first male locking portion.

EXAMPLE 9

The container assembly of any combination of Examples 1-8, wherein the first shell component includes a chamfered corner, wherein the second shell component includes an unchamfered corner, and wherein the chamfered corner is proximate the unchamfered corner when the second female locking portion is releasably locked with the first male locking portion.

EXAMPLE 10

The container assembly of any combination of Examples 1-9, wherein the unchamfered corner includes a tab.

EXAMPLE 11

The container assembly of any combination of Examples 1-10, wherein the tab includes a tab projection and defines a tab recess.

EXAMPLE 12

The container assembly of any combination of Examples 1-11, wherein the first shell component includes a plurality of feet extending outwardly away from the first outer wall.

EXAMPLE 13

The container assembly of any combination of Examples 1-12, wherein the first side wall is non-linear.

EXAMPLE 14

The container assembly of any combination of Examples 1-13, wherein the first shell component and the second shell component are identical.

EXAMPLE 15

A method of forming a container assembly, the method comprising selecting a first shell component from a plurality of shell components; selecting a second shell component from the plurality of shell components; connecting a male locking portion of the first shell component with a female locking portion of the second shell component; and connecting a female locking portion of the first shell component with a male locking portion of the second shell component.

EXAMPLE 16

The method of Example 15, further comprising rotating the first shell component 180-degrees to align the male locking portion of the first shell component with the female locking portion of the second shell component.

EXAMPLE 17

The container assembly of any combination of Examples 15 and 16, further comprising disposing an unchamfered corner of the first shell component proximate a chamfered corner of the second shell component when the male locking portion of the first shell component is connected with the female locking portion of the second shell component.

EXAMPLE 18

The container assembly of any combination of Examples 15-17, further comprising pulling a tab disposed on the unchamfered corner of the first shell component to release the male locking portion of the first shell component from the female locking portion of the second shell component.

EXAMPLE 19

A container assembly comprising a first shell component, wherein the first shell component includes a peripheral lip, a male projection region, and a female recess region; a second shell component, wherein the second shell component includes a peripheral lip, a male projection region, and a female projection region; wherein the male projection region of the first shell component is configured to be received in the female recess region of the second shell component; wherein the female projection region of the first shell component is configured to receive the male projection region of the second shell component; and wherein the peripheral lip of the first shell component is parallel to the peripheral lip of the second shell component when the male projection region of the first shell component is received in the female recess region of the second shell component.

EXAMPLE 20

The container assembly of Example 19, wherein the first shell component further includes a tab disposed on an unchamfered corner, wherein the second shell component further includes a chamfered corner, and wherein unchamfered corner is adjacent the chamfered corner when the male projection region of the first shell component is received in the female recess region of the second shell component.

VI. Miscellaneous

It should be understood that any of the examples described herein may include various other features in addition to or in lieu of those described above. By way of example only, any of the examples described herein may also include one or more of the various features disclosed in any of the various references that are incorporated by reference herein.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various versions of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A container assembly comprising:

(a) a first shell component, wherein the first shell component includes a first side wall, a first outer wall, a first male locking portion having a first cross-sectional profile, and a first female locking portion;

(b) a second shell component, wherein the second shell component includes a second side wall, a second outer wall, a second male locking portion, and a second female locking portion having a second cross-sectional profile;

wherein the first male locking portion is configured to releasably lock with the second female locking portion;

wherein the first male locking portion includes a first male lip and a second male lip;

wherein the first male lip and the second male lip are disposed along a vertical plane when the container is assembled;

wherein the first female locking portion is configured to releasably lock with the second male locking portion;

wherein the second female locking portion includes a first female recess and a second female recess;

wherein the first female recess and the second female recess are disposed along the vertical plane when the container is assembled;

wherein the first female recess is configured to receive the first male lip therein when the second female locking portion is releasably locked with the first male locking portion;

wherein the second female recess is configured to receive the second male lip therein when the second female locking portion is releasably locked with the first male locking portion;

wherein the first cross-sectional profile and the second cross-sectional profile are non-identical; and wherein the first shell component is reflectively asymmetrical, and wherein the first shell component is rotationally asymmetrical.

2. The container assembly of claim 1, wherein the first shell component is reflectively asymmetrical, and wherein the first shell component is rotationally asymmetrical.

3. The container assembly of claim 1, wherein the first male locking portion includes a male recess disposed vertically between the first male lip and the second male lip, wherein the second female locking portion includes a female lip disposed vertically between the first female recess and the second female recess, and wherein the male recess is configured to receive the female lip therein when the second female locking portion is releasably locked with the first male locking portion.

4. The container assembly of claim 3, wherein the lower male wall is parallel with the first outer wall, and wherein the lower female wall is parallel with the second outer wall when the second female locking portion is releasably locked with the first male locking portion.

5. The container assembly of claim 4, wherein the first shell component includes a lip extending along the entire periphery of the first shell component, wherein the second shell component includes a lip extending along the entire periphery of the second shell component, wherein the lip of the first shell component is parallel with the lip of the second shell component when the second female locking portion is releasably locked with the first male locking portion.

6. The container assembly of claim 5, wherein the first shell component includes a chamfered corner, wherein the second shell component includes an unchamfered corner, and wherein the chamfered corner is proximate the unchamfered corner when the second female locking portion is releasably locked with the first male locking portion.

7. The container assembly of claim 6, wherein the unchamfered corner includes a tab.

8. The container assembly of claim 7, wherein the tab includes a tab projection and defines a tab recess.

9. The container assembly of claim 8, wherein the first shell component includes a plurality of feet extending outwardly away from the first outer wall.

10. The container assembly of claim 9, wherein the first side wall is non-linear.

11. The container assembly of claim 10, wherein the first shell component and the second shell component are identical.

12. A container assembly comprising:

(a) a first shell component, wherein the first shell component includes a first side wall, a first outer wall, a first male locking portion having a first cross-sectional profile, and a first female locking portion;

(b) a second shell component, wherein the second shell component includes a second side wall, a second outer wall, a second male locking portion, and a second female locking portion having a second cross-sectional profile;

wherein the first male locking portion is configured to releasably lock with the second female locking portion;

wherein the first male locking portion includes a first male lip and a second male lip;

wherein the first male lip and the second male lip are disposed along a vertical plane when the container is assembled;

wherein the first female locking portion is configured to releasably lock with the second male locking portion;

wherein the second female locking portion includes a first female recess and a second female recess;

wherein the first female recess and the second female recess are disposed along the vertical plane when the container is assembled;

wherein the first female recess is configured to receive the first male lip therein when the second female locking portion is releasably locked with the first male locking portion;

wherein the second female recess is configured to receive the second male lip therein when the second female locking portion is releasably locked with the first male locking portion;

wherein the first cross-sectional profile and the second cross-sectional profile are non-identical; and wherein the first shell component includes a chamfered corner, wherein the second shell component includes an unchamfered corner, and wherein the chamfered corner is proximate the unchamfered corner when the second female locking portion is releasably locked with the first male locking portion.

13. The container assembly of claim 12, wherein the unchamfered corner includes a tab.

14. The container assembly of claim 13, wherein the tab includes a tab projection and defines a tab recess.

15. The container assembly of claim 14, wherein the first shell component includes a plurality of feet extending outwardly away from the first outer wall.

16. The container assembly of claim 15, wherein the first side wall is non- linear.

17. The container assembly of claim 16, wherein the first shell component and the second shell component are identical.

18. A container assembly comprising:

(a) a first shell component, wherein the first shell component includes a first side wall, a first outer wall, a first male locking portion having a first cross-sectional profile, and a first female locking portion;

(b) a second shell component, wherein the second shell component includes a second side wall, a second outer wall, a second male locking portion, and a second female locking portion having a second cross-sectional profile;

wherein the first male locking portion is configured to releasably lock with the second female locking portion;

wherein the first male locking portion includes a first male lip and a second male lip;

wherein the first male lip and the second male lip are disposed along a vertical plane when the container is assembled;

wherein the first female locking portion is configured to releasably lock with the second male locking portion;

wherein the second female locking portion includes a first female recess and a second female recess;

wherein the first female recess and the second female recess are disposed along the vertical plane when the container is assembled;

wherein the first female recess is configured to receive the first male lip therein when the second female locking portion is releasably locked with the first male locking portion;

wherein the second female recess is configured to receive the second male lip therein when the second female locking portion is releasably locked with the first male locking portion;

wherein the first cross-sectional profile and the second cross-sectional profile are non-identical; and wherein the first shell component and the second shell component are identical.

19. The container assembly of claim 18, wherein the first male locking portion includes a male recess disposed vertically between the first male lip and the second male lip, wherein the second female locking portion includes a female lip disposed vertically between the first female recess and the second female recess, and wherein the male recess is configured to receive the female lip therein when the second female locking portion is releasably locked with the first male locking portion.

20. The container assembly of claim 19, wherein the first male locking portion includes a lower male wall, wherein the second female locking portion includes a lower female wall, and wherein the lower male wall is configured to abut the lower female wall when the second female locking portion is releasably locked with the first male locking portion.

* * * * *